United States Patent [19]

Schminke

[11] 4,263,023

[45] Apr. 21, 1981

[54] MULTIZONE ELECTROSTATIC PRECIPITATOR

[75] Inventor: Heinz Schminke, Egelsbach, Fed. Rep. of Germany

[73] Assignee: Metallgesellschaft Aktiengesellschaft, Frankfurt am Main, Fed. Rep. of Germany

[21] Appl. No.: 112,819

[22] Filed: Jan. 17, 1980

[30] Foreign Application Priority Data

Feb. 6, 1979 [DE] Fed. Rep. of Germany ..... 2904339

[51] Int. Cl.[3] ..... B03C 3/76

[52] U.S. Cl. ..... 55/112; 55/130; 55/137; 55/147; 55/156

[58] Field of Search ..... 55/112, 130, 136–137, 55/147, 156

[56] References Cited

U.S. PATENT DOCUMENTS

| | | | |
|---|---|---|---|
| 2,061,045 | 11/1936 | Ruder et al. | 55/136 |
| 2,297,555 | 9/1942 | Hedberg | 55/112 |
| 3,755,991 | 9/1973 | Steuernagel | 55/156 X |
| 3,803,809 | 4/1974 | Gelhaar et al. | 55/156 X |

FOREIGN PATENT DOCUMENTS 1869720 4/1963 Fed. Rep. of Germany .

*Primary Examiner*—Kathleen J. Prunner
*Attorney, Agent, or Firm*—Karl F. Ross

[57] ABSTRACT

A multizone vertical-flow electrostatic precipitator, particularly for intermittent operation, comprises collecting electrodes consisting of plate strips which extend vertically through all of a plurality of separating zones and which are entirely smooth in the direction of gas flow and have a constant shape in cross section (in planes perpendicular to the gas flow). The separating zones are each provided with separate tension frames supporting the corona-discharge electrodes, the frames being electrically insulated from one another. The system of the invention eliminates the need for double-wall electrodes and special means for preventing entrainment of collected dust by the gases traversing the spaces between the collecting electrode walls.

7 Claims, 4 Drawing Figures

MULTIZONE ELECTROSTATIC PRECIPITATOR

FIELD OF THE INVENTION

My present invention relates to electrostatic precipitators and, more particularly, to multizone vertical-flow electrostatic precipitators of the type in which a dust-carrying gas passes upwardly through the electrostatic precipitator unit through a plurality of zones providing different electrostatic-precipitation conditions.

Specifically this invention relates to a multizone vertical-flow electrostatic precipitator particularly for purifying exhaust gases from tipping troughs, transfer pits, casting ladles and the like means used in steelmaking, but also for electrostatic precipitating applications involving a danger of explosion, e.g. in plants for grinding coal and coke, where vertical-flow units are preferred owing to the improved pressure relief.

BACKGROUND OF THE INVENTION

Increasing efforts have been made to purify the exhaust gases which become available at high rates, e.g. in refuse incinerator plants or power plant boilers, and to avoid air pollution by smaller exhaust gas sources.

In steelmaking plants, such smaller exhaust gas sources can include tipping troughs, transfer pits, casting ladles and the like as well as various grinding units and may produce exhaust gases at a rate of up to 150 $m^3$/sec. Even though these gases often become available only periodically, they must be cleaned before their discharge into the atmosphere because they would otherwise add substantially to the pollution of the environment.

In the design of electrostatic precipitators for such applications it must be borne in mind that dust is to be collected from gases which have a very high dust content with a large proportion of fines and that even this very fine dust must be collected if the gas is to be cleaned to the high degree which is desired and is required by law.

It is known that very fine dusts cannot be collected in electrostatic precipitators unless the latter comprise a plurality of separating zones successively traversed by the gas and in which discharge conditions can be selected to match the different dust resistivities. Thus the several high-voltage zones must be separately controlled.

A multizone design is also desirable to avoid a failure of the entire plant when a single corona-discharge wire has broken. By law, in some jurisdictions, the plant must be so designed that all dust in excess of, e.g. 150 mg/$m^3$ is removed from the gas even when one zone has failed.

It is also desirable to minimize the capital investment. For this purpose, most electrostatic precipitators used for such purposes are arranged for a vertically rising gas flow so that no exhaust gas blowers are required in most cases because the natural draft of the hot gases is sufficient to overcome the pressure drop in the electrostatic precipitator.

However, electrostatic precipitators traversed by the gas vertically have the basic disadvantage that special structure is required to remove the collected dust from the collecting electrodes so that the collected dust is not raised and entrained by the following gas. In most cases, double-wall collecting electrode panels are used, these panels being provided with horizontally extending dust-receiving means, such as slots, pockets or the like, which deliver the dust to the space between the walls of the double-wall electrodes. From that space, which is not traversed by the gas, the dust is discharged by gravity out of the electrostatic precipitator.

The added cost of such collecting electrodes more or less offsets the decrease in capital investment resulting from the elimination of the need for a blower or from the use of only a very small blower for assisting the natural draft or the plant is even more expensive.

Reference may also be made to U.S. Pat. Nos. 3,803,809, U.S. Pat. 4,058,377 and U.S. Pat. 4,035,886, which relate to strip-type collector electrodes and corona-discharge electrode support frames (see also U.S. Pat. No. 3,745,620).

These patents and the literature or references cited in the files thereof demonstrate that the formation of electrode walls and corona-discharge electrode systems are known in the art.

Nevertheless, there has not been provided heretofore, to my knowledge, any vertical flow electrostatic precipitator which is of the desired high efficiency, low cost and simplicity long sought after in dust-cleaning applications in which a large proportion of fines is included in the dust to be removed from the gas.

OBJECTS OF THE INVENTION

It is the principal object of the present invention to provide an electrostatic precipitator which is suitable for use in all of the above-described applications, which meets all technological requirements and complies with all legal provisions regarding the processing of exhaust gases, and which is particularly effective and efficient where gases become available with strongly fluctuating volume flow rate and different dust contents.

Another object of the invention is to provide a vertical-flow electrostatic precipitator which is particularly effective for removing large quantities of very fine dusts at relatively low cost.

It is a collateral object of the invention to provide an electrostatic precipitator which affords a high capacity and efficiency, but with minimum capital expenditure.

In the most general terms, it is an object of the invention to provide an electrostatic precipitator for use in an exhaust gas cleaning plant which will facilitate compliance with legal requirements relating to the control of air pollution, which will meet the demands of the public that air pollution solutions be found quickly and be effective, and which will ensure compliance with all existing legal requirements.

SUMMARY OF THE INVENTION

I have now discovered, quite surprisingly, that the complex solutions offered in the past to the handling of large volumes in natural-draft electrostatic precipitators, with high fines content, can be solved, not by increasing the complexity of the unit but rather by simplifying it in a way which has not been conceived heretofore because of the concern with the reentrainment problem.

More particularly, I have found that it is possible to provide a vertical-flow electrostatic precipitator having a plurality of superposed, but discrete collecting zones successively traversed by the gas stream, with collecting electrode walls extending through all of the zones, i.e. vertically, and being smooth in the direction of travel of the gas, i.e. in the vertical direction. This means that these electrodes are free from any discontinuities, e.g. openings for collecting of dust or otherwise, along their length in the direction of gas flow.

According to an essential feature of the invention, which must be taken in combination with this configuration of collecting electrodes, the discharge electrodes are provided in separate frames for each zone and the frames of the zones are separated from one another by respective insulators (see for example the commonly assigned copending application Ser. No. 086,122, filed Oct. 18, 1979).

Thus, according to the invention, the collecting electrodes consist of plate strips, which extend vertically through all separating zones and which are entirely smooth in the direction of gas flow and have a constant shape in cross-section (taken transverse to the flow), and that the discharge electrodes of each separating zone are mounted in separate tensioning frames, which are electrically separated from the other tensioning frames.

In accordance with the invention, the conventional double-wall collecting electrodes provided with separate dust-receiving means are replaced by simple plate strips, both side faces of which can be used as collecting surfaces and which extend vertically through all separating zones so that they can be suspended with relatively inexpensive means.

The plate strips consist preferably of longitudinally extending sheet metal elements which are profiled in cross-section and have longitudinal edges which are hook-shaped in cross-section as a result of bending or flanging or the like operations and interengage so that the plate strips are loosely connected to form collecting electrode walls without any need for additional connecting means.

According to a further feature of the invention, the collecting electrode walls are provided in known manner with rapping means for vibrating the collecting electrode walls by applying horizontal blows in the plane of each collecting electrode wall. The collecting electrode walls may desirably consist of plate strips as disclosed in German Utility Model No. 18 69 720, which have been developed for horizontal-flow electrostatic precipitators.

The capital investment involved in an electrostatic precipitator according to the invention may be 20 to 30% less, depending on size, than that involved in a conventional vertical-flow electrostatic precipitator having collecting electrode walls which are specially designed to ensure the removal of the collected dust without a raising of dust.

For this reason, very simple collecting electrode walls, which are entirely smooth in the direction of gas flow, may be used in accordance with the invention without any risk that the collecting capacity of the electrostatic precipitator may be adversely affected.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
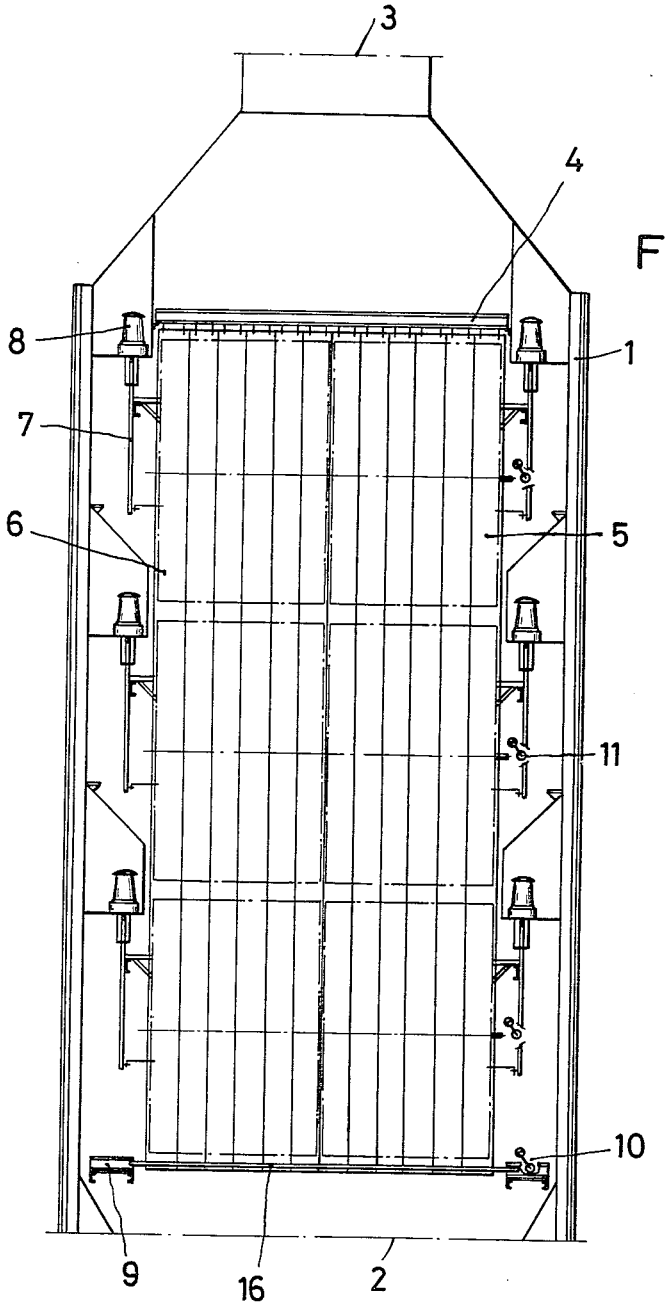
FIG. 1 is a sectional view showing a vertical-flow three-zone electrostatic precipitator having a collecting electrode wall shown in elevation.

In accordance with FIG. 1 the electrostatic precipitator comprises a housing 1 which has at the bottom a gas inlet portion 2 and at the top a gas outlet portion 3. Collecting electrodes consisting of integral plate strips 5 are suspended from horizontal beams 4.

The discharge electrodes are held by tension frames 6, which are electrically separated from each other. The tensioning frames are suspended in the housing by means of rods 7 and insulators 8. The collecting electrode walls are provided at their lower ends with rapping rods 16, which are mounted in a guide 9. Known rapping mechanisms 10 and 11 are provided for cleaning the collecting and discharge electrodes.

Figure 2:
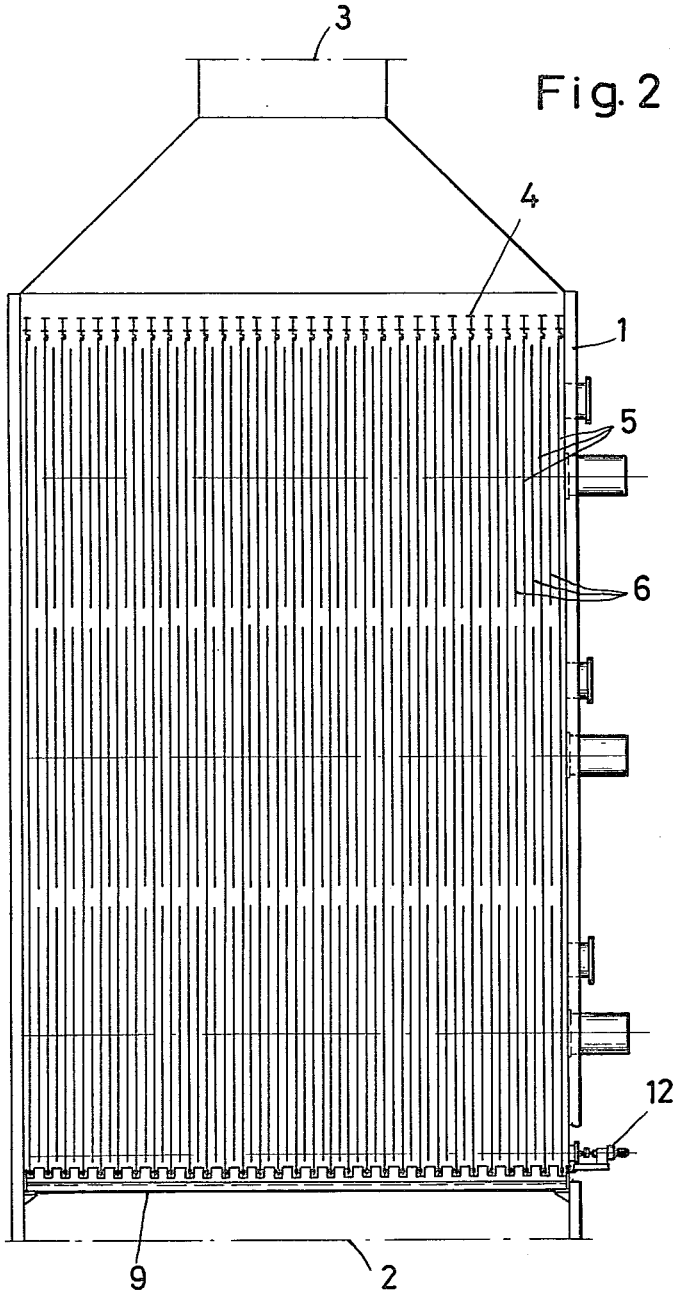
FIG. 2 is a sectional view showing the same electrostatic precipitator and taken on a plane at right angles to the section plane of FIG. 1.

The housing 1 comprising the inlet portion 2 and the outlet portion 3 is shown in FIG. 2 in a sectional view taken on a plane which is at right angles to that of FIG. 1.

The plate strips 5 are suspended from horizontal beams 4 and at their lower ends are mounted in a guide 9. Tensioning frames 6 which hold the discharge electrodes are disposed between adjacent collecting electrode walls. Numeral 12 designates drive means for the rapping mechanism 10 for the collecting electrode walls.

Figure 3:
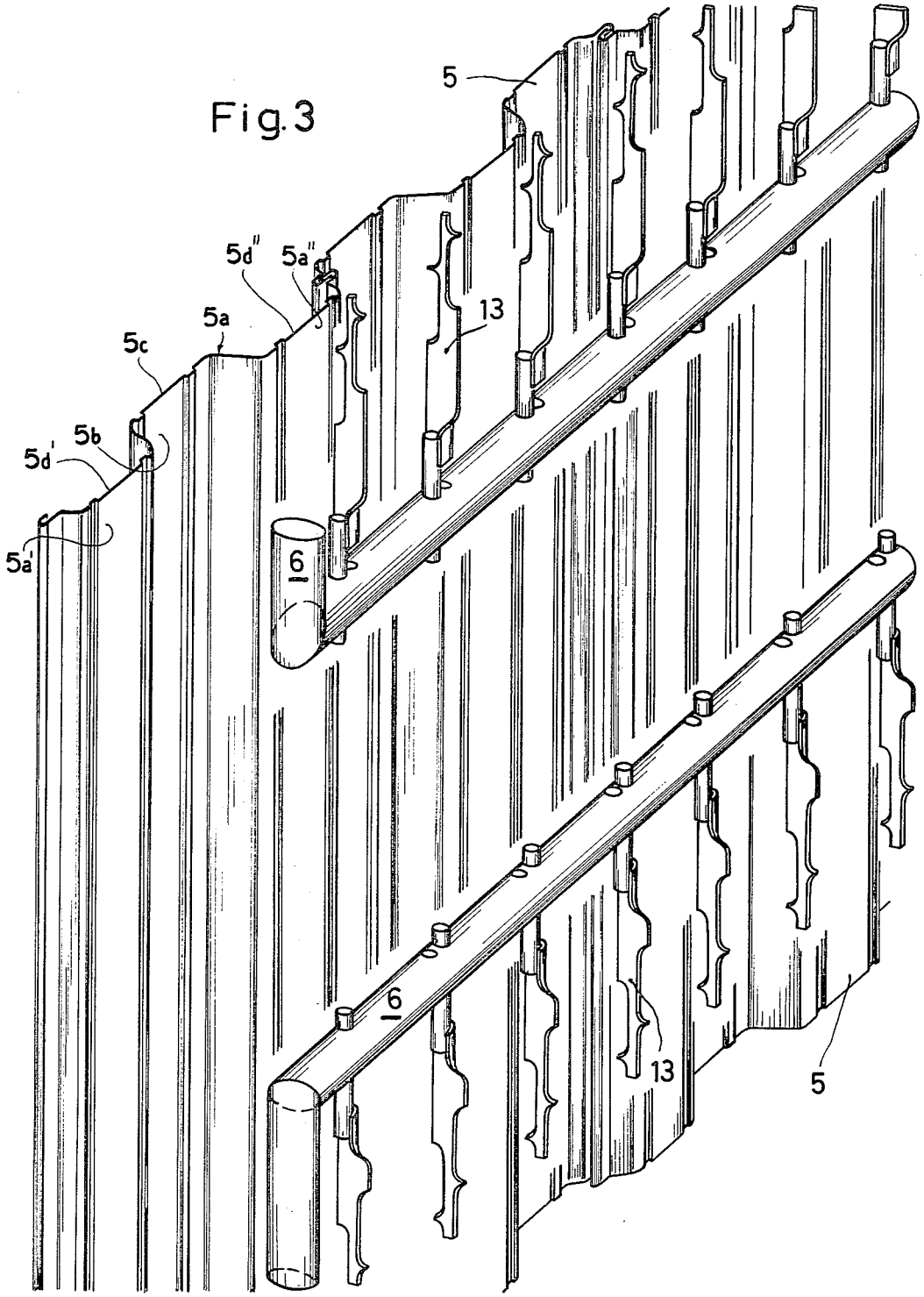
FIG. 3 is a perspective view showing a detail.

FIG. 3 is an enlarged perspective view showing a detail. Each collecting electrode wall consists of a plurality of plate strips 5, which are angled in a trapezoidal configuration in cross-section. A tensioning frame 6 which holds discharge electrodes 13 is disposed between adjacent collecting electrode walls.

Figure 4:
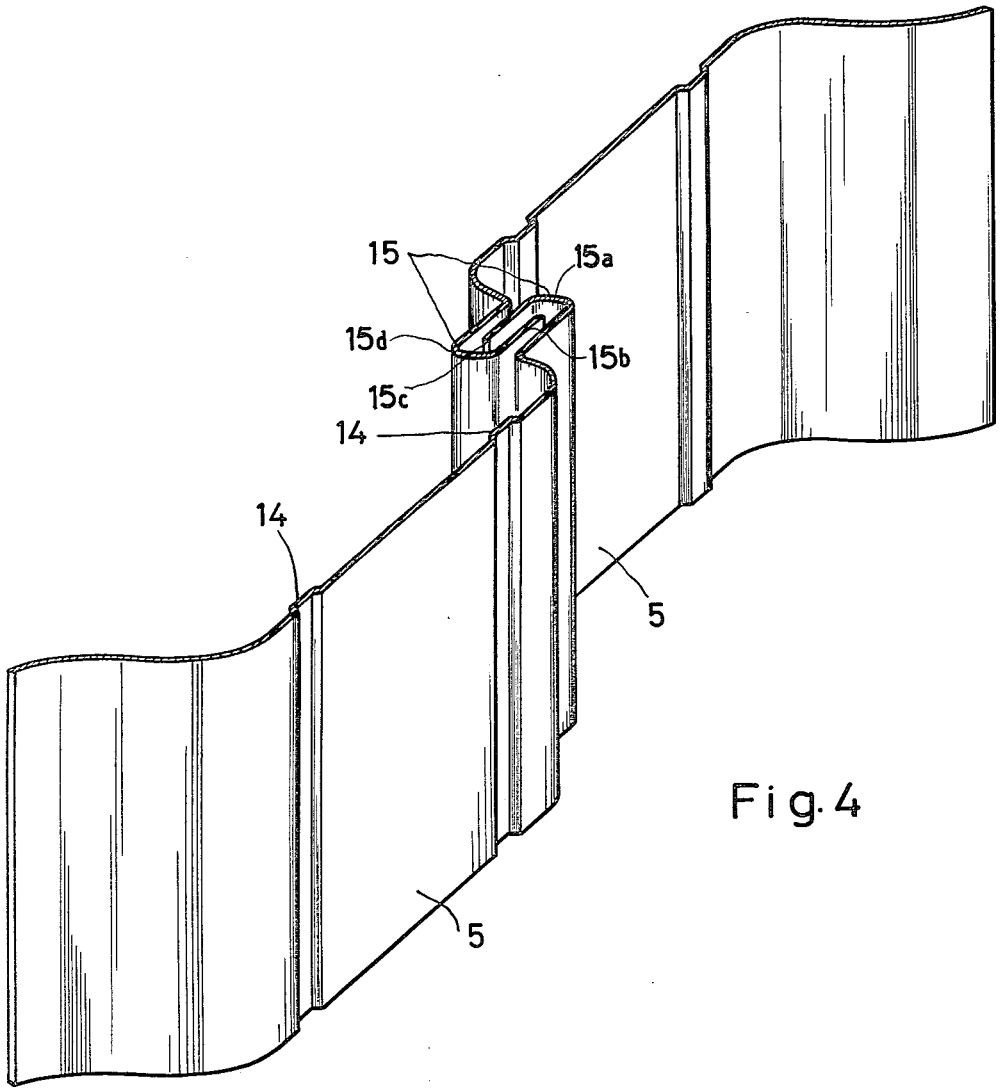
FIG. 4 is a transverse-sectional view showing the joint between two plate strips.

FIG. 4 is a further enlarged perspective view showing the joint between two plate strips. The plate strips 5 are reinforced by continuous beads 14 and have U-shaped longitudinal edge portions 15. By means of the longitudinal edge portions 15, the plate strips 5 are interconnected to form collecting electrode walls without a need for other connecting means.

The insulators 8, while shown to be mounted within the housing, can also be erected in antechambers as illustrated in the aforementioned copending application. Moreover, the electrode frames with their corona-discharge electrodes may be tensioned and constructed as set forth in the patent mentioned previously.

The interlocking construction of the plate strips, whereby they loosely engage at their longitudinal edges, can be so formed that the longitudinal strip 5 shown on the left in FIG. 4 has a channel 15*a* opening toward the left and receiving the flange 15*b* of the other plate strip. Its flange, in turn, as shown at 15*c* can be received in the oppositely opening channel 15*d* of the second plate strip. Each of the plate strips may be corrugated in a direction transverse to the direction of gas flow as has been shown in FIG. 3. Thus the plate strip 5*a* is provided with two crests 5*a*′ and 5*a*″ to one side, separated by a trough 5*b* which, in turn, forms a crest 5*c* on the opposite side, flanked by the troughs 5*d*′ and 5*d*″ corresponding to the crests 5*a*′ and 5*a*″. Advantageously, the beads 14 open in the direction to which the crests project and like the crests are of trapezoidal cross section.

I claim:

1. A multizone vertical-flow electrostatic precipitator, particularly for use in applications with fluctuating gas flow rates, comprising:

a vertically-elongated upright housing formed with an inlet for a dust-entraining gas at its bottom and an outlet for gas freed from dust at its top;

a multiplicity of sets of discharge electrodes spaced one above another in said housing, each of said sets comprising a plurality of tensioning frames spanned by respective corona-discharge electrodes, each set of tensioning frames defining a respective electrostatic precipitator zone, said zones being traversed in succession by the dust-entraining gas;

a single array of collecting electrodes in said housing disposed such that the collecting electrodes are located between pairs of tensioning frames of each set, each of said collecting electrodes consisting of plate strips extending vertically continuously through all of said zones and entirely smooth in the direction of gas flow substantially over their entire lengths and having a constant shape in cross section; and means for electrically mounting said sets of frames in said housing for electrically separating the frames of each set from the frames of the other set.

2. The electrostatic precipitator defined in claim 1 wherein each of said plate strips consists of a plurality of longitudinally extending sheet-metal elements of profiled cross section, said elements having longitudinal edges of hook-shaped cross section and loosely interfitting to form collecting electrode walls.

3. The electrostatic precipitator defined in claim 1 or claim 2 wherein said collecting electrodes are provided with rapping means for vibrating so as to dislodge dust therefrom.

4. The electrostatic precipitator defined in claim 3 wherein said rapping means is so constructed and arranged as to apply horizontal blows in the plane of each of said collecting electrodes.

5. The electrostatic precipitator defined in claim 1 or claim 2 further comprising rapping means connected to said frames for dislodging dust from said discharge electrodes.

6. The electrostatic precipitator defined in claim 1 or 2 wherein said collecting electrodes have the configuration of corrugated walls, the corrugations being of trapezoidal cross section with alternating crests and troughs.

7. The electrostatic precipitator defined in claim 6 wherein each of said crests is formed with at least one longitudinally extending reinforcing bead.

* * * * *